US008516945B2

(12) United States Patent
Morath

(10) Patent No.: US 8,516,945 B2
(45) Date of Patent: Aug. 27, 2013

(54) PISTON-CYLINDER UNIT

(75) Inventor: Erwin Morath, Lauterach (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 1028 days.

(21) Appl. No.: 12/548,592

(22) Filed: Aug. 27, 2009

(65) Prior Publication Data

US 2010/0050864 A1 Mar. 4, 2010

(30) Foreign Application Priority Data

Aug. 29, 2008 (DE) ..... 20 2008 011 557 U
Apr. 8, 2009 (DE) ..... 20 2009 004 673 U

(51) Int. Cl.
*F15B 15/20* (2006.01)
*B66C 23/88* (2006.01)

(52) U.S. Cl.
USPC ..... 92/5 R; 91/1

(58) Field of Classification Search
USPC ..... 92/5 R; 91/1
See application file for complete search history.

(56) References Cited

U.S. PATENT DOCUMENTS

| | | | | |
|---|---|---|---|---|
| 3,726,191 | A * | 4/1973 | Johnston et al. | 92/5 R |
| 4,700,610 | A * | 10/1987 | Bauer et al. | 91/1 |
| 4,879,440 | A * | 11/1989 | Lymburner | 92/5 R |
| 6,588,313 | B2 * | 7/2003 | Brown et al. | 92/5 R |
| 6,722,261 | B1 * | 4/2004 | Brown et al. | 92/5 R |
| 7,143,682 | B2 * | 12/2006 | Nissing et al. | 92/5 R |

FOREIGN PATENT DOCUMENTS

| | | | |
|---|---|---|---|
| DE | 7923662 | | 11/1979 |
| DE | 7923662 | U1 * | 11/1979 |
| DE | 8508933 | U1 | 7/1985 |
| DE | 3634730 | | 4/1988 |
| DE | 4120643 | | 12/1992 |
| DE | 10320382 | | 12/2004 |
| DE | 202005006795 | | 7/2005 |
| EP | 1366253 | | 9/2006 |
| FR | 1525363 | A | 5/1968 |

* cited by examiner

*Primary Examiner* — Thomas E Lazo
(74) *Attorney, Agent, or Firm* — Dilworth & Barrese LLP

(57) ABSTRACT

The present invention relates to a piston-cylinder unit with a piston with adjoining piston rod, which is movably mounted in a cylinder, wherein the piston and the piston rod have a cavity into which at least one rod protrudes, by means of which an electrically conductive connection can be made directly or indirectly.

21 Claims, 5 Drawing Sheets

PISTON-CYLINDER UNIT

BACKGROUND OF THE INVENTION

This invention relates to a piston-cylinder unit as it is typically used in cranes, for instance truck or crawler cranes.

Especially in crane construction, problems frequently arise where signals and electrical connections must be guided to places located far away. Sometimes, these points also are connected with the basic machine in a length-variable manner, such as when supporting a crane. When supporting a crane, one would like to know for instance which vertical forces are absorbed by props. For this purpose corresponding sensors are provided. One possible solution consists in that at the end of the so-called supporting foot a force sensor is provided. This can be taken for instance from EP 1 366 253 B1, in which a sensor is provided between the supporting beam and the supporting plate or at the end of the supporting beam. From DE 10 32 03 82 A1 it is known to provide a cable connection between sliding beam and supporting plate.

The sensors provided in the piston-cylinder unit supply data which in use in a truck or crawler crane must be supplied to the crane controller. In addition, the sensor requires energy. The connection known from the prior art has great problems, since the cables generally are guided freely and thus are exposed to damages. As far as the connecting cables are used in the support of a truck or crawler crane, it must be taken into account that this support can be shifted both in horizontal direction (by the sliding beams) and in vertical direction (by the supporting cylinders).

SUMMARY OF THE INVENTION

It is the object of the invention to develop a known piston-cylinder unit such that sensors provided in the same can be supplied with energy in a safe and simple way, and that the signals generated by the sensors can be transmitted just as simply.

In accordance with the invention, this object is solved by the features herein.

Accordingly, there is proposed a piston-cylinder unit with a piston with adjoining piston rod, which is movably mounted in a cylinder, wherein the piston and the piston rod have a cavity into which at least one rod protrudes, by means of which an electrically conducting connection can be made directly or indirectly.

Preferred aspects of the invention can be taken from the description herein.

Accordingly, at least along part of its length the inside of the piston rod can be coated with an insulator layer, on the outside of which a conductive layer in turn is applied.

In accordance with another advantageous aspect, a rod can be arranged in the cavity of the piston and the piston rod, on which a conductive layer is applied.

In accordance with another advantageous embodiment of the invention, the rod provided with an electrical connector can be attached to the upper surface of the cylinder and plunge into the cavity of the piston rod and the piston, wherein the rod is electrically conductively connected with the conductive layer in the piston rod. This electrical connection advantageously can consist of a spring-loaded slip connection.

Preferably, the rod provided with an electrical connector and attached to the upper surface of the cylinder can include an insulator layer, wherein the rod selectively arranged in the cavity of the piston and the piston rod plunges into the hollow rod attached to the upper surface of the cylinder.

Advantageously, an electric insulation can be provided between the rod and the cylinder wall. Thus, voltage can be applied to the rod, without said voltage being transmitted to the cylinder.

At the electrically conducting portions of the piston rod, at least one sensor can be arranged, which can be supplied with electricity via the electric conductor.

Advantageously, the measured values of the at least one sensor can be forwarded to and evaluated by the existing controller by means of a voltage modulation of the energy supply.

In accordance with another advantageous aspect of the invention, the conductive layer on the insulator layer can cover a partial length (a) of the piston rod, so that the electrical contact of the immersing rod is interrupted upon leaving the conductive region, wherein leaving the conductive region can be detected by a controller.

In this case, the conductive layer thus is chosen with a suitable length. If the piston now is drawn out of the cylinder too far, the contact between the rod and the conductive layer is interrupted. If the piston rod now has left this defined region, the controller no longer receives a signal from the at least one sensor inside the cylinder. By means of an existing controller, a specific routine can be started here, such as output of a warning signal or even intervention in the controller in the form of a stop of movement. It thus can be prevented in a simple way that the piston-cylinder unit is "bottomed out". When using a piston-cylinder unit in the support of a truck or crawler crane, the piston-cylinder unit can easily be "bottomed out" by the crane operator extending the cylinder very far, so that it "bottoms out".

On the other hand, however, the crane operator also can extend the piston to such an extent that it can cover only a small distance, until it "bottoms out". If support has been effected at a low temperature, and subsequently strong heating occurs for instance due to exposure to sunlight, the oil in the cylinder can expand so much that the piston rod is pushed out further and subsequently is "bottomed out". This so-called "bottoming out" safely is prevented by the aforementioned monitoring of the length.

In accordance with another advantageous aspect of the invention, an optical displacement sensor with associated central processing unit (CPU) can be provided, by means of which the voltage supply of downstream sensors is effected. The displacement sensor can pick up the voltage modulated by the sensors and provide the same to the main controller via a bus connection beside its own measurement results. The sensors can for instance measure the supporting force of a supporting plate of a supporting device of a truck crane.

BRIEF DESCRIPTION OF THE DRAWINGS

Further details and advantages of the invention will be explained in detail with reference to an embodiment illustrated in the drawing, in which.

DESCRIPTION OF THE PREFERRED EMBODIMENTS

Figure 1:
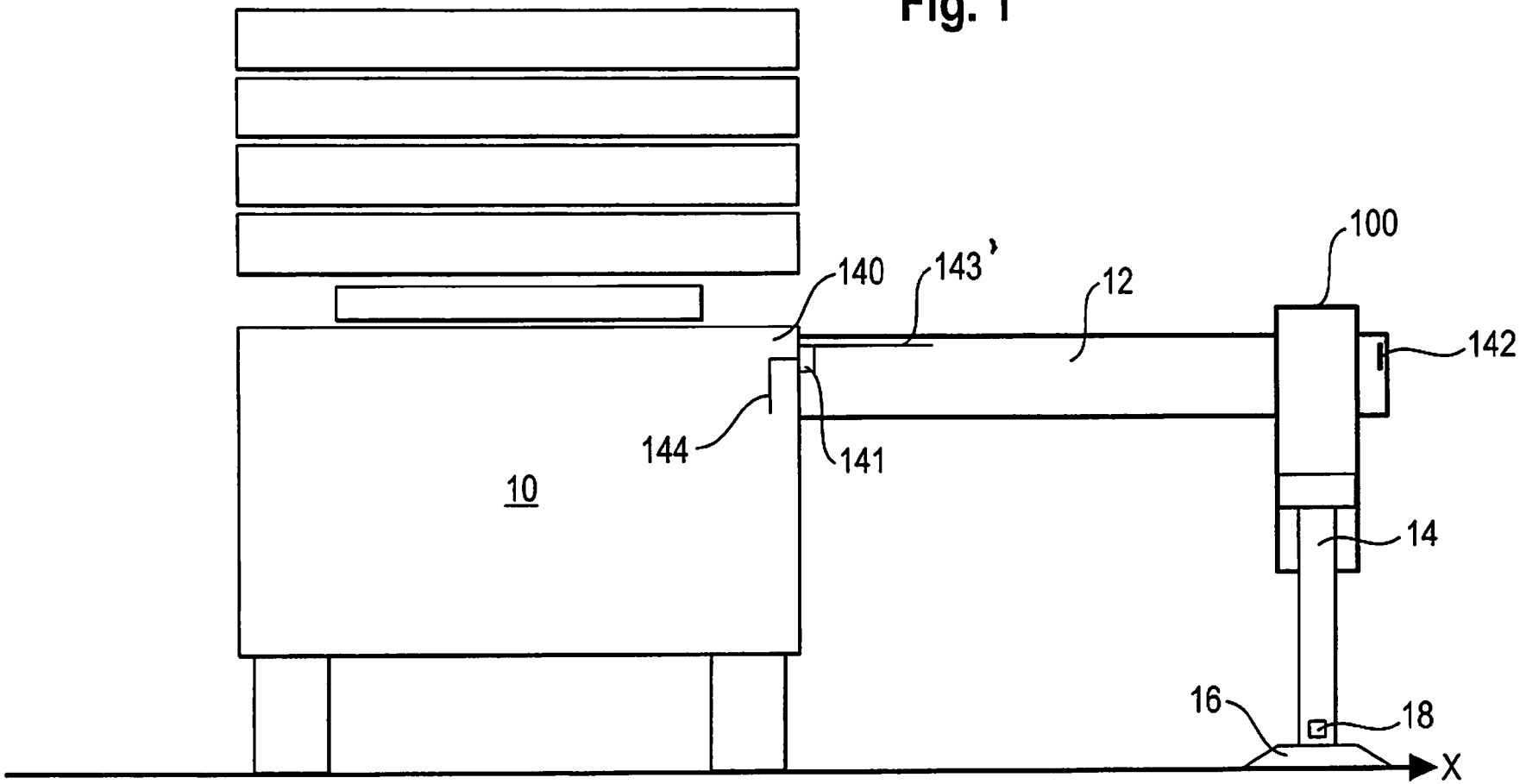
FIG. 1: shows the use of a piston-cylinder unit of the invention in connection with the support of a truck crane.

FIG. 1 schematically shows a truck crane 10 with an extended sliding beam 12. The extendable sliding beam 12 includes a piston-cylinder unit 14, at whose free end a supporting plate 16 is arranged for support on the ground. For detecting the supporting force, a force sensor 18 is arranged in the piston-cylinder unit 14. The inventive structure of the piston-cylinder unit 14 can be taken from FIGS. 2 to 4. The piston-cylinder unit 14 substantially consists of a cylinder 100, a piston 110 and an adjoining piston rod 120. The supporting plate 16 and a force sensor 18 for measuring the supporting force likewise are arranged in FIG. 2.

On the upper surface of the cylinder 100, an electrically conducting rod 130 is mounted and guided to the outside of the cylinder 100. On the outside of the cylinder, the rod 130 is connected with an electrical connector 132 (cf. FIG. 4). Between the cylinder wall of the cylinder 100 and the rod 130 an electric insulation 131 is provided.

Figure 2:
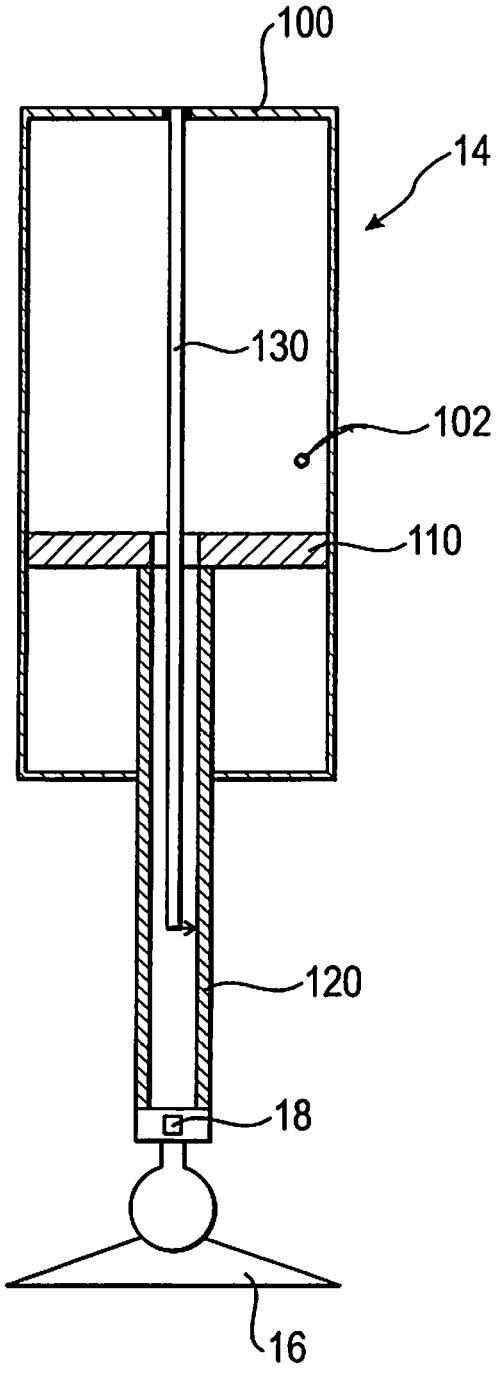
FIG. 2: shows a section through a piston-cylinder unit as it is shown in FIG. 1 by way of example.
Figure 4:
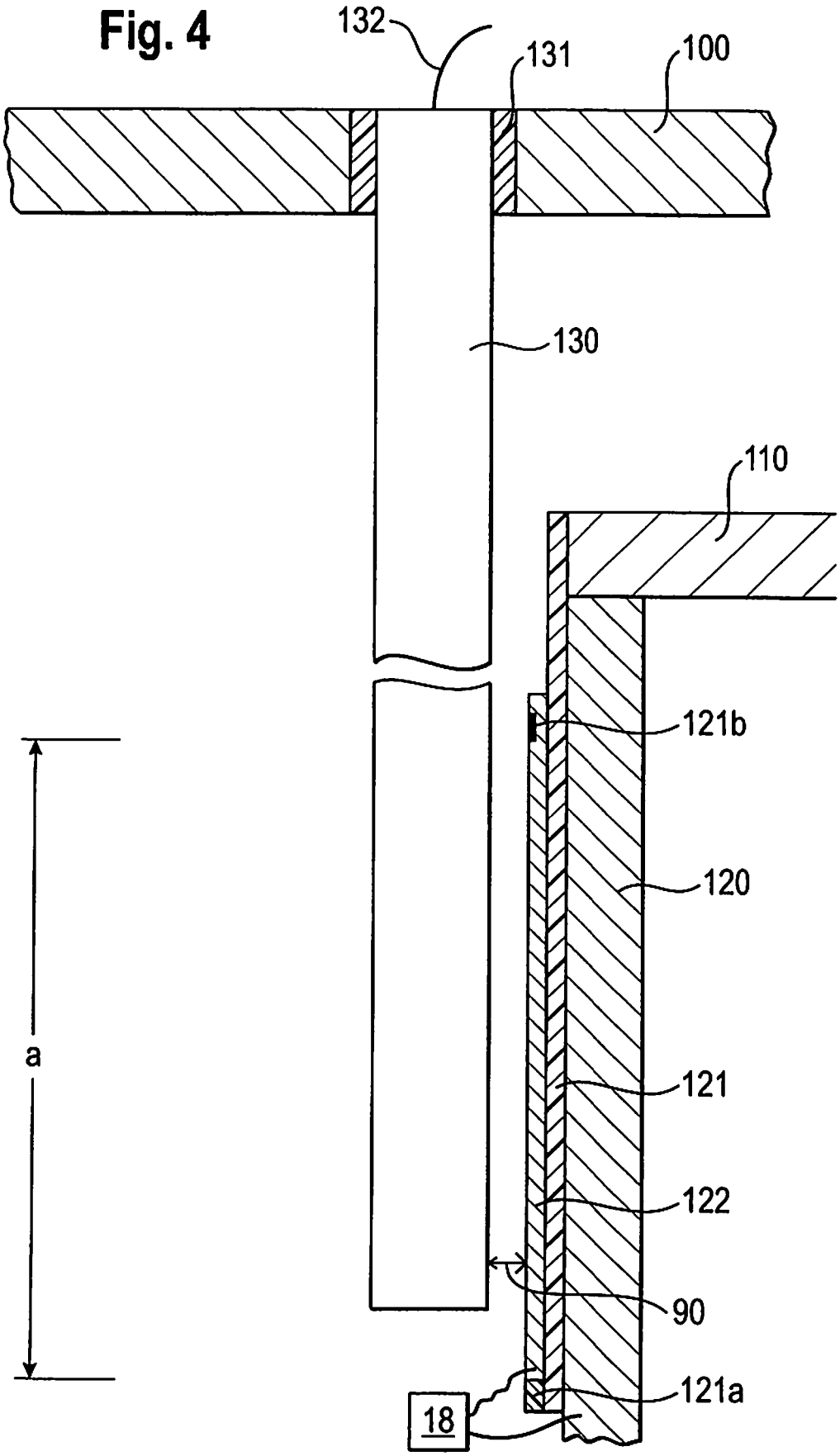

Both the piston 110 and the piston rod 120 have a through hole or cavity, into which the rod 130 plunges, as is shown in FIG. 2 and FIG. 4. For operability of the piston-cylinder unit, tightness must of course be ensured with respect to the hydraulic oil in the piston rod over the intended pressure range. This tightness must also be present with respect to the connection of the rod 130 in the cylinder 100, as described above. On the other hand, an insulation against the hydraulic oil is not necessary, since the same itself is electrically non-conducting.

The rod 130 protrudes into the cylinder space 102, through the piston 110 and into the interior of the piston rod 120. This interior either is present anyway, since the piston rod is made of a tube, or is provided especially. The rod 130 has a length adapted to the recess in the piston rod 120. It protrudes into the same both in the fully extended and in the fully retracted condition of the piston rod 120 inside the piston-cylinder unit 14.

As can be taken from FIG. 4, the inside of the piston rod 120 is provided with an insolator layer 121. On this insulator layer 121, another conductive layer 122 is applied along a specific length a. Both the conductive layer 122 and the insulator layer 121 can be applied onto the inside of the piston rod 120 in various ways. On the one hand, for instance, cylinders or also flat materials can be applied here. The layers can also be provided by vapor deposition, galvanic methods or the like. In accordance with the present invention, the manufacturing method for these layers is not important. It is, however, necessary for the invention that here two electrically separate poles are realized both in and on the piston rod 120.

Between the rod 130 and the conductive layer 122 a connection is provided, for instance a slip connection. This connection is shown in FIG. 4 in simplified form by the double arrow 90. Advantageously, the same can be effected via a spring-loaded slip connection. It is irrelevant whether the slip connection is attached to the conductive layer 122 or to the rod 130. The connection advantageously can also serve as an additional bearing of the rod 130. It might also be provided at the level of the piston 110, so that the rod 130 can be made particularly short.

Due to the aforementioned structure, two separate conductors now are obtained at the end of the piston rod 120. On the one hand, this is the piston rod 120 itself and on the other hand the conductive layer 122. To these two conductors, one or more sensors can be connected, such as the force sensor 18. In this way, the at least one sensor can be supplied with energy.

In accordance with an alternative embodiment of the invention, which is not shown here in greater detail, two rods can also be used instead of the one rod 130.

Beside the energy supply for the at least one sensor, the data generated by the sensors must of course also be forwarded to the existing controller. On the one hand, this can be effected contactless in a known way by remote data transmission. For this case, however, further components must be provided. Alternatively, the voltage of the energy supply can be modulated in a particularly advantageous way corresponding to the respective signal. This modulation then is picked up and evaluated by a controller.

This requires distincly fewer and less expensive components than in the aforementioned remote data transmission. In principle, this kind of modulation is already known to one of skill in the art.

Figure 3:
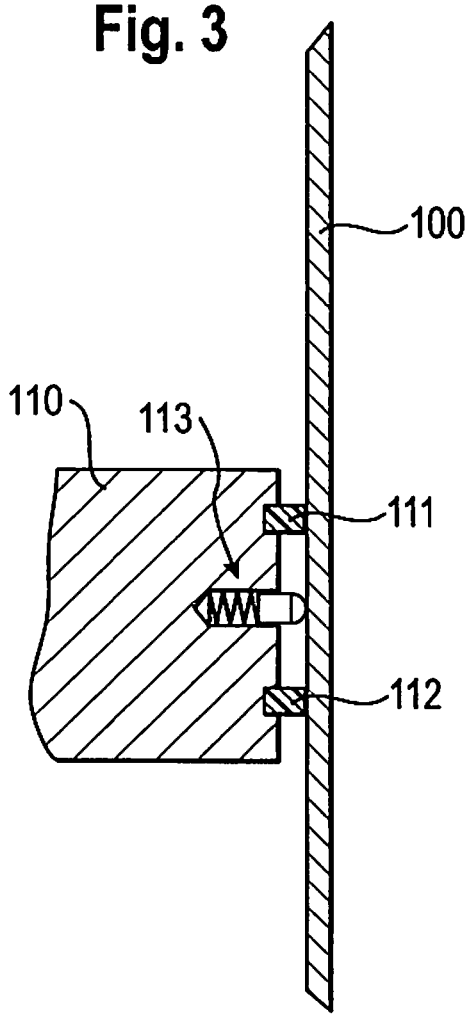
FIG. 3: shows a detail of FIG. 2, FIG. 4: shows another schematic detail of FIG. 2, FIG. 5: shows an alternative embodiment of a piston-cylinder unit in accordance with the present invention in the extended position.

FIG. 3 shows a detail of the piston 110, which rests against the wall of the cylinder 100 via the seals 111 and 112. The seals 111 and 112 can consist of insulators, so that in this case a spring-loaded slip connection 113 can be provided to produce a safe conductive connection.

In FIG. 4, the length of the conductive layer 122 is chosen such that in this way a monitoring circuit for preventing an excessive extension of the piston 110 from the cylinder is created and so-called "bottoming out" generated thereby is prevented at the same time. If the piston 110 is extended too much, there is no conductive connection between the rod 130 and the conductive layer 122. In case the piston rod 120 has left the defined region, the non-illustrated controller no longer receives a signal from the sensor(s) at the foot of the support. Thus, a specific routine can be started. Due to the arrangement of the conductive layer 122 and a safety distance adjustable thereby, the "bottoming out" to be prevented can be excluded in a simple and effective way. Since the controller knows in what direction the cylinder is moved, it even is defined on what side the cylinder has left the admissible region. In FIG. 4, a first possibility of path limitation by an insulator layer 121*a* and a second possibility of path limitation by an insulator layer 121*b* is realized. The path to be travelled results from the path (a) freely accessible for the slip connection 90.

The inventive piston-cylinder unit explained above can be arranged particularly advantageously in a support in an extendable sliding beam 12 of a truck crane 10, as it is shown in FIG. 1. Particularly advantageously, an optical sensor 141 known per se can be arranged at the sliding beam box 140, i.e. at the stationary part of the support. Then, a corresponding reflector 142 is arranged at the sliding beam 12. The optical sensor 141 and the reflector 142 (wireless between the same) detect the length of extension of the sliding beam 12. Thus, this further parameter relevant for the safe support of a truck crane 10 can also be measured and be forwarded to the controller. Thus, only a single line 143' is necessary in the sliding beam 12 for electric connection. This line starts at the optical sensor 141. The optical sensor 141 additionally comprises a CPU, which can pick up the signals of the sensor 18 and of possibly existing further sensors from the piston-cylinder unit, process the same and thus supply the same to the crane controller (not shown here) via its own bus connection 144.

Figure 5:
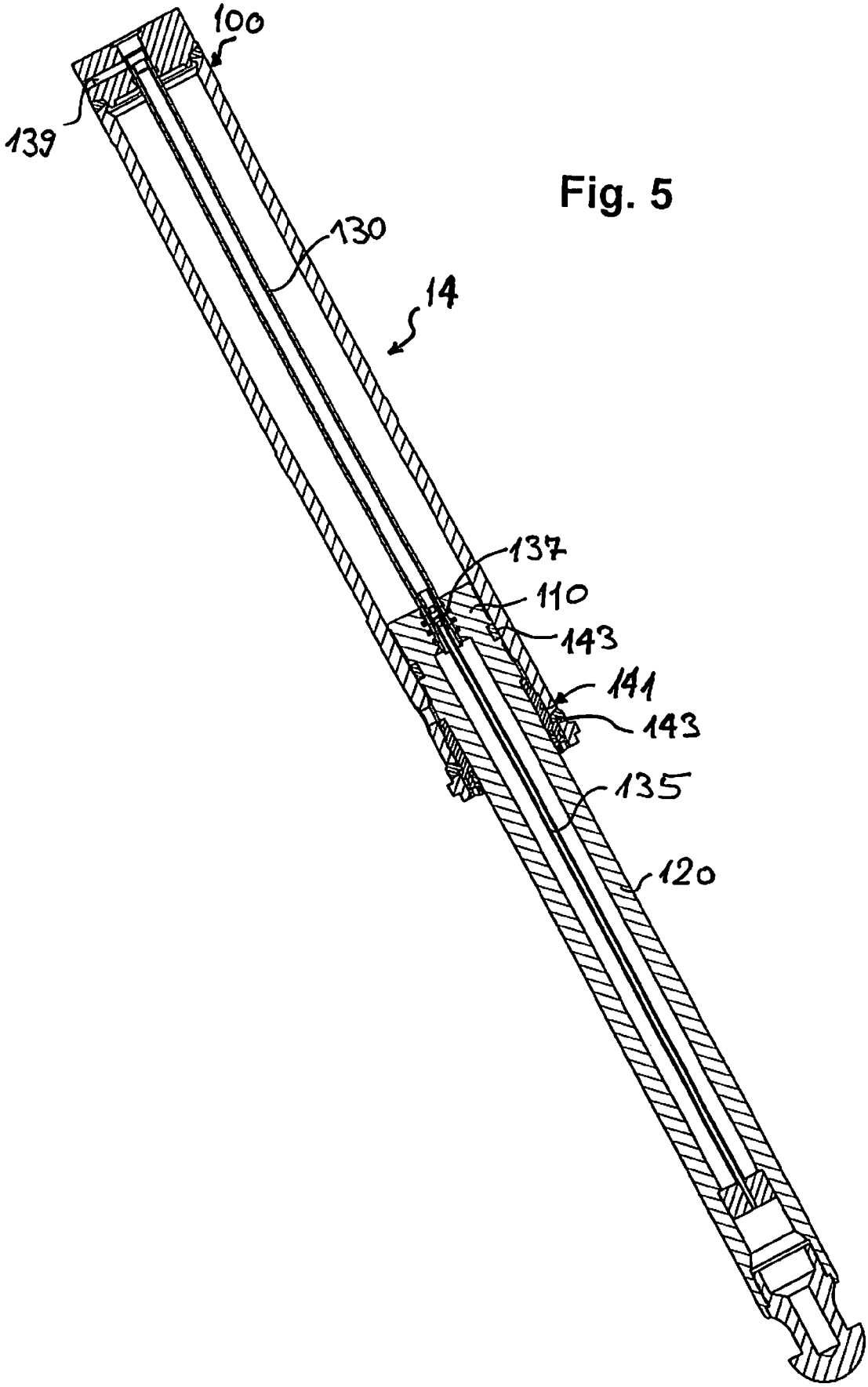
Figure 6:
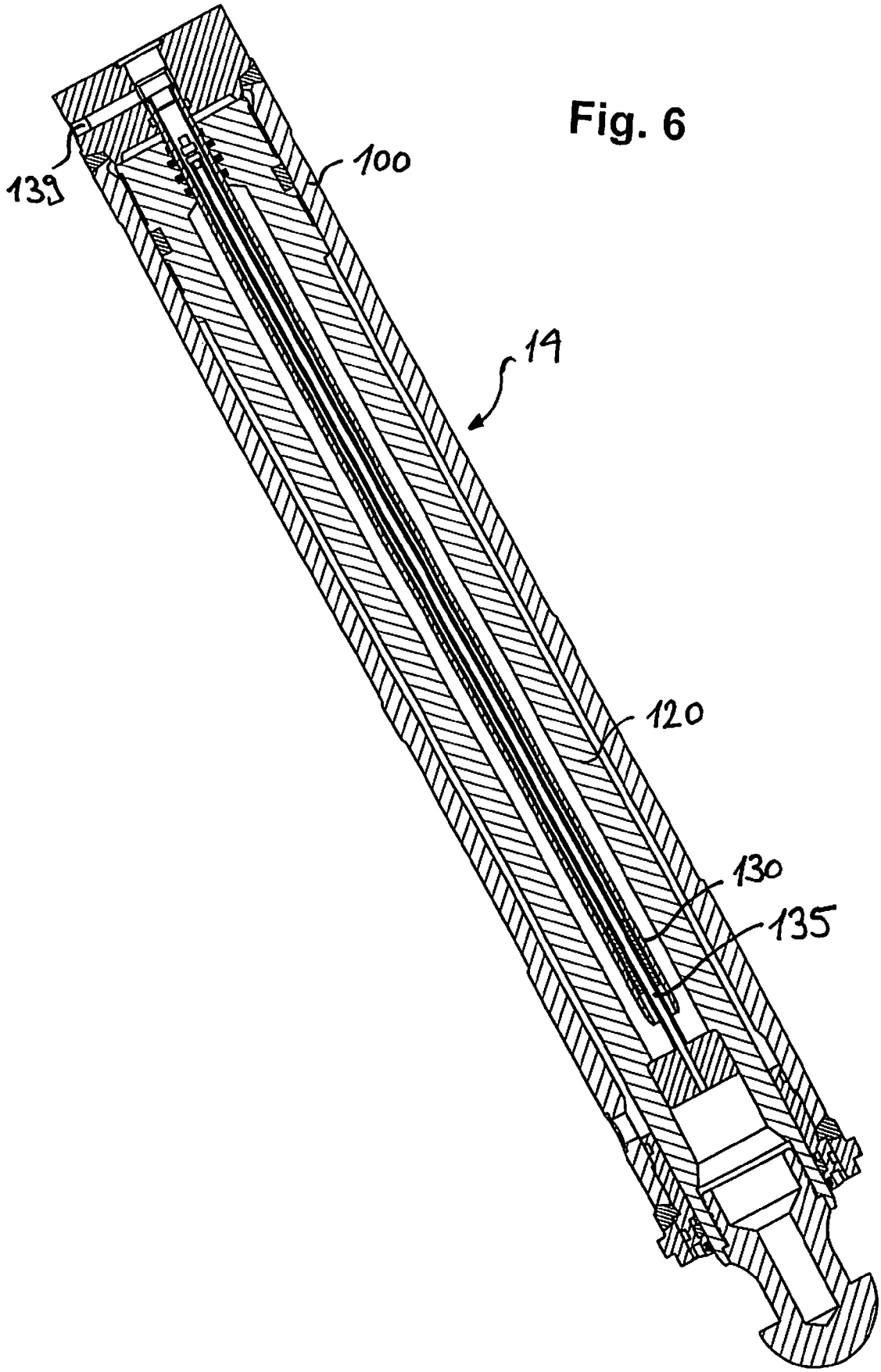
FIG. 6: shows the embodiment of FIG. 5 in the retracted position.

In FIGS. 5 and 6, an alternative embodiment of the invention is shown. Here, an alternatively constructed piston-cylinder unit 14 is shown, in which the supporting plate 16 for support on the ground is not attached. Here as well, the piston-cylinder unit 14 substantially consists of a cylinder 100 and an adjoining piston rod 120. Here as well, a rod 130 is attached to the upper surface of the cylinder.

Both the piston rod 120 and the adjoining piston 110 each include a through hole or cavity, in which another rod 135 is arranged. As can be taken from the comparison of FIGS. 5 and 6, this rod 135 extends inside a cavity of the rod 130 mounted in the cylinder 100. On the piston-side rod 135, slip connections 137 are arranged.

Via a bore 139 in the cylinder 100, power supply to the rod 130 can be effected in a manner not shown here in greater detail.

The second electrical contact 141 is realized between the cylinder 100 and the piston rod 120. Here, it is advantageous that the non-illustrated contact pin is not provided in the vicinity of the cylinder space, i.e. high pressure, but in the vicinity of the ring surface 143, i.e. low pressure.

In accordance with the invention, a number of modifications of the construction described above is possible.

It is possible, for instance, to make the bore in the piston 110, which is provided according to FIG. 2, smaller than the inside diameter of the piston rod. Then, not only an electrically insulated guideway, but also an electrically insulated sealing between the piston 110 and the rod 130 might be provided. The space in the piston rod then can be configured free from oil and thus free from pressure, which basically simplifies a technical realization.

In accordance with the invention, the solution illustrated in FIG. 2 can also be reversed. In this case, a larger rod would be attached to the upper end of the cylinder and might protrude through the piston into the piston rod. Between the piston and the larger rod, seals would then be provided, so that the space of the piston rod no longer is filled with oil. From the bottom of the piston rod a smaller rod can protrude into the larger rod. In this alternative construction, the contact surfaces provided in FIG. 4 would be arranged in the large rod.

The force sensor 18 for measuring the supporting force on the one hand must be supplied with energy and on the other hand its measurement results must be forwarded to the controller. When the force sensor is an LSB-bus-compatible transducer, both requirements can be satisfied by a cable with digital signal transmission. For this purpose, a storage capacitor is mounted in the vicinity of the force sensor 18. Via the LSB-bus, the capacitor then is charged during the phase in which voltage is applied and is discharged during the phase in which no voltage is applied. Then, it supplies the force sensor 18 with the required power. The capacitance of the capacitor must be adapted to the power consumption of the force sensor 18 and to the maximum duration of the dead phase of the transmission protocol in the LSB-bus. Signal transmission is effected as already described above.

The invention claimed is:

1. A piston-cylinder unit with a piston with adjoining piston rod, which is movably mounted in a cylinder, the piston-cylinder unit comprising a sensor provided on a piston rod side of the piston cylinder unit, wherein the piston and the piston rod have a cavity into which at least one rod protrudes, by which an electrically conducting connection to the sensor is provided directly or indirectly, wherein the conductive layer on the insulator layer covers a partial length (a) of the piston rod, so that the electric contact of the plunging rod is interrupted upon leaving the conductive region, and leaving the conductive region can be detected by a controller.

2. The piston-cylinder unit according to claim 1, wherein between the rod and the cylinder wall an electric insulation is provided.

3. The piston-cylinder unit according to claim 1, wherein a displacement sensor, in particular an optical displacement sensor, with associated central processing unit (CPU) is provided, by which the voltage supply of the sensor is effected.

4. The piston-cylinder unit according to claim 3, wherein the displacement sensor picks up the voltage modulated by the sensor and provides the same to the main controller beside its own measurement results via a bus connection.

5. The piston-cylinder unit according to claim 4, wherein between the rod and the cylinder wall an electric insulation is provided.

6. The piston-cylinder unit according to claim 1, wherein the sensor is a bus-compatible transducer, that a storage capacitor is connected with the force sensor, and both the transmission of energy and the transmission of measured values are effected by the same cable.

7. The piston-cylinder unit according to claim 6, wherein between the rod and the cylinder wall an electric insulation is provided.

8. The piston-cylinder unit according to claim 1 wherein the sensor is a force sensor.

9. A piston-cylinder unit with a piston with adjoining piston rod, which is movably mounted in a cylinder, the piston-cylinder unit comprising a sensor provided on a piston rod side of the piston cylinder unit, wherein the piston and the piston rod have a cavity into which at least one rod protrudes, by which an electrically conducting connection to the sensor is provided directly or indirectly, wherein at least along part of its length, the inside of the piston rod is coated with an insulator layer, on the outside of which a conductive layer in turn is applied.

10. The piston-cylinder unit according to claim 9, wherein the rod provided with the electrically conducting connection is attached to an upper surface of the cylinder and plunges into the cavity of the piston rod and piston, and the rod is electrically conductively connected with the conductive layer in the piston rod.

11. The piston-cylinder unit according to claim 10, wherein the connection consists of a spring-loaded slip connection.

12. The piston-cylinder unit according to claim 11, wherein the sensor is connected to an electrically conducting portion of the piston rod thereby providing a second electric contact by which the sensor is supplied with electricity.

13. The piston-cylinder unit according to claim 12, wherein the second electric contact is provided by a contact made between the cylinder and the electrically conducting portion of the piston rod.

14. The piston-cylinder unit according to claim 12, wherein the measured values of the at least one sensor can be forwarded to the existing controller by a voltage modulation of the energy supply.

15. A piston-cylinder unit with a piston with adjoining piston rod, which is movably mounted in a cylinder, the piston-cylinder unit comprising a sensor provided on a piston rod side of the piston cylinder unit, wherein the piston and the piston rod have a cavity into which at least one rod protrudes, by which an electrically conducting connection to the sensor is provided directly or indirectly, wherein in the cavity of the piston and the piston rod a rod is arranged, on which a conductive layer is applied.

16. The piston-cylinder unit according to claim 15, wherein the rod provided with an electrical connector is attached to the upper surface of the cylinder and plunges into the cavity of the piston rod and piston, and the rod is electrically conductively connected with the conductive layer in the piston rod.

17. The piston-cylinder unit according to claim 16, wherein between the rod and the cylinder wall an electric insulation is provided.

18. A piston-cylinder unit with a piston with adjoining piston rod, which is movably mounted in a cylinder, the piston-cylinder unit comprising a sensor provided on a piston rod side of the piston cylinder unit, wherein the piston and the piston rod have a cavity into which at least one rod protrudes, by which an electrically conducting connection to the sensor is provided directly or indirectly, wherein in the cavity of the piston and the piston rod a second rod is arranged on which a conductive layer is applied, wherein the rod provided with an electrical connector and attached to the upper surface of the cylinder has a hollow bore and includes an insulator layer, and the second rod arranged in the cavity of the piston and the piston rod plunges into the hollow bore.

19. The piston-cylinder unit according to claim 18, wherein the connection consists of a spring-loaded slip connection.

20. The piston-cylinder unit according to claim 19, wherein between the rod and the cylinder wall an electric insulation is provided.

21. A crane comprising a sliding beam which includes a piston-cylinder unit having a piston with an adjoining piston rod, which is movably mounted in a cylinder for supporting the crane on the ground, a force sensor which is mechanically coupled to a piston rod side of the piston-cylinder unit for measuring a supporting force, wherein the piston and the piston rod have a cavity into which at least one rod protrudes, by means of which an electrically conducting connection to the sensor is directly or indirectly provided.

* * * * *